United States Patent [19]

Hill

[11] 4,039,638

[45] Aug. 2, 1977

[54] FUEL SUPPLY SYSTEM FOR AN INTERNAL COMBUSTION ENGINE

[75] Inventor: William Frank Hill, Stafford, England

[73] Assignee: Lucas Electrical Limited, Birmingham, England

[21] Appl. No.: 657,659

[22] Filed: Feb. 12, 1976

[30] Foreign Application Priority Data

Feb. 22, 1975 United Kingdom ..... 7551/75

[51] Int. Cl.[2] ..... F02M 7/06

[52] U.S. Cl. ..... 261/72 R; 261/DIG. 67; 261/DIG. 74; 123/119 EC

[58] Field of Search ..... 261/DIG. 67, DIG. 74, 261/72 R, 73; 123/119 EC

[56] References Cited

U.S. PATENT DOCUMENTS

| | | | |
|---|---|---|---|
| 2,796,243 | 6/1957 | McDuffie | 261/DIG. 67 |
| 3,548,792 | 12/1970 | Palmer | 261/121 B |
| 3,689,755 | 9/1975 | Hodgson et al. | 123/32 EA |
| 3,730,157 | 5/1973 | Gerhold | 261/DIG. 67 |
| 3,742,924 | 7/1973 | Bachle | 261/DIG. 67 |
| 3,789,812 | 2/1974 | Berry | 261/DIG. 67 |
| 3,794,302 | 2/1974 | Diener | 261/DIG. 74 |
| 3,831,910 | 8/1974 | Shadbolt | 261/DIG. 67 |
| 3,900,014 | 8/1975 | Bundesen et al. | 261/DIG. 67 |
| 3,906,910 | 9/1975 | Szlaga, Jr. | 261/121 B |
| 3,921,612 | 11/1975 | Aono | 261/DIG. 67 |

FOREIGN PATENT DOCUMENTS

| | | | |
|---|---|---|---|
| 4,006,371 | 11/1969 | Japan | 261/DIG. 67 |
| 179,121 | 3/1966 | U.S.S.R. | 261/DIG. 67 |

*Primary Examiner*—Tim R. Miles

*Attorney, Agent, or Firm*—Ladas, Parry, Von Gehr, Goldsmith & Deschamps

[57] ABSTRACT

An i.c. engine fuel system uses a conventional carburettor modified by the addition of an air pressure control to the float chamber thereof. The air pressure control includes a bank of valves connected in parallel to exhaust a chamber connected by an orifice to the engine intake manifold. The chamber is connected to the float chamber and the valves are controlled by the individual bits of a digital output signal produced by a digital read only memory addressed by digital signals corresponding to two engine parameters such as engine speed and throttle angle.

2 Claims, 2 Drawing Figures

FUEL SUPPLY SYSTEM FOR AN INTERNAL COMBUSTION ENGINE

This invention relates to a fuel supply system for an internal combustion engine and has as an object to provide such a system which is capable of accurately controlling fuel flow to the engine in accordance with engine operating conditions.

A system in accordance with the invention comprises a carburettor including a float chamber in which the level of fuel is controlled to determine the rate of fuel flow through an orifice into the air intake of the engine, and means controlling the air pressure in an air space in said float chamber to vary the rate of fuel flow through said orifice said control means including a read only memory programmed to provide an output signal varying in accordance with one or more input signals corresponding to one or more engine operating parameters.

Preferably the memory provides an n-bit digital output and the control means also includes a plurality of valves respectively controlling a plurality of orifices of different sizes in parallel in a passage connecting the air space in the float chamber to the engine air inlet, said air space being also connected to the intake manifold downstream of the throttle valve, via a fixed orifice, said valves being controlled by respective bits of the digital output.

In the accompanying drawings,

FIG. 3 is a block diagram of an alternative form of the invention.

Figure 1:
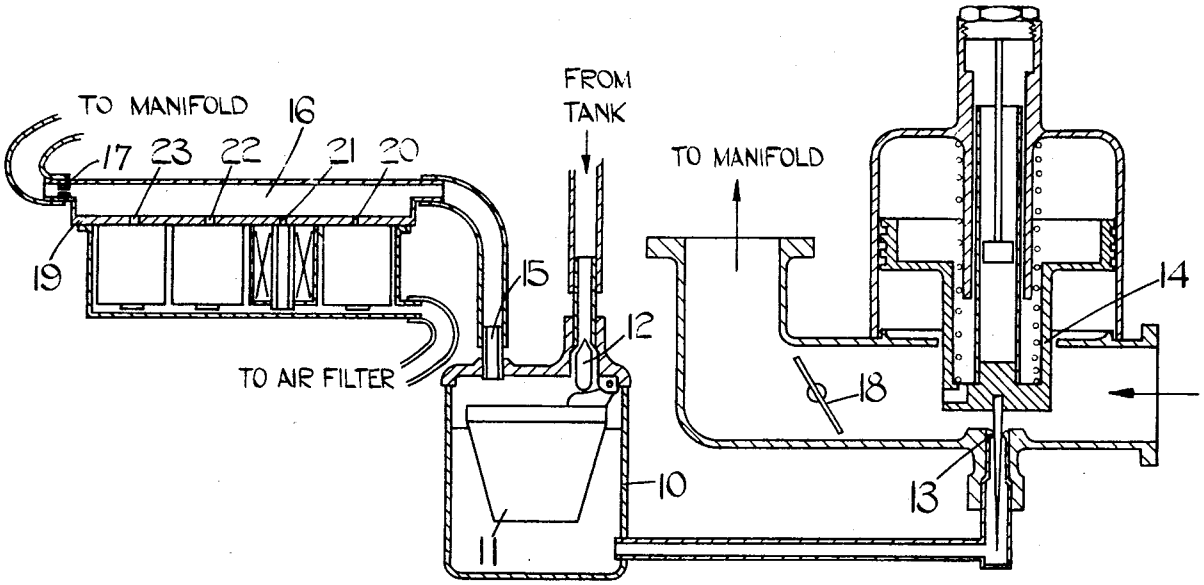
FIG. 1 is a somewhat diagrammatic sectional view of a carburettor and air pressure control device incorporated in an example of a system according to the invention.
Figure 2:
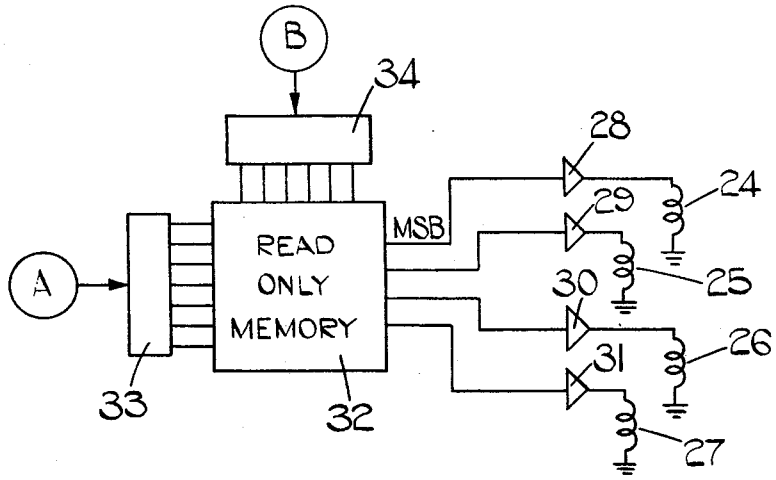
FIG. 2 is a block diagram of the system.

The carburettor shown in FIG. 1 is a conventional variable orifice carburettor, having a float chamber 10 containing a float 11 which operates a valve 12 controlling the admission of fuel to the float chamber so as to provide a constant head of fuel. The float chamber is connected to an orifice 13 which is variable by a needle on an airflow control member 14 of conventional form. The carburettor is adjusted so as to operate normally but to give a fuel/air mixture which is somewhat rich, but on which the associated engine will run albeit uneconomically.

The float chamber is provided with a tapping 15 opening into an air space above the normal fuel level in the float chamber 10. This tapping is connected to a chamber 16 which is connected via a fixed orifice 17 to the engine air intake manifold (downstream of the airflow control member 14 and the throttle valve 18). The chamber is bounded on one side by a plate 19 formed with a series of different sized orifices 20, 21, 22 and 23. These orifices are controlled by solenoid valves 24, 25, 26 and 27 respectively so that the pressure in the chamber 16 (and therefore in the air space in the float chamber) varies according to what combination of the valves 24, 25, 26 and 27 is energised.

The valves 24 to 27 29, operated, through the intermediary of suitable interface circuits 28, 2, 30 and 31, by a four-bit digital signal derived from a read only memory matrix 32. The memory 32 has digital inputs representing two different engine operating parameters, such as the angle of throttle 18 and the actual running speed of the engine. These parameters are measured by transducers A and B and the signals produced by these are supplied to the memory matrix through suitable interface circuits 33 and 34.

The memory matrix is empirically programmed to provide a digital output signal corresponding to each combination of input signals. The valves 24 to 27 are operated by this output signal and cause the pressure in the air space in the float chamber 10 to be depressed to an extent sufficient to reduce the rate of fuel flow into the engine to the rate required for that combination of throttle angle and engine speed.

It will be appreciated that although accurate metering of fuel only occurs when the electronic circuit is operating, the engine can still be run should the circuit fail.

The invention can also be applied to simple fixed-jet type carburettors.

The fixed orifice 17 may be replaced by an array of valve controlled orifices or by a servo-controlled orifice controlled by the output of the memory. This enables a wider control pressure range to be achieved.

I claim:

1. A fuel supply system for an internal combustion engine comprising a carburettor including a float chamber in which the level of fuel is controlled to determine the rate of fuel flow through an orifice into the air intake of the engine, and means controlling the air pressure in an air space in said float chamber to vary the rate of fuel flow through said orifice, said control means including a read only memory programmed to provide an n-bit digital output signal varying in accordance with one or more input signals corresponding to one or more engine operating parameters, and a plurality of valves respectively controlling a plurality of orifices of different sizes in parallel in a passage connecting the air space in the float chamber to the engine air inlet, said air space being also connected to the intake manifold downstream of the throttle valve via an orifice, said valves being controlled by respective bits of the digital output.

2. A system as claimed in claim 1 in which said last-mentioned orifice is a fixed orifice.

* * * * *